US012296877B2

(12) United States Patent
Hu et al.

(10) Patent No.: US 12,296,877 B2
(45) Date of Patent: May 13, 2025

(54) SAFETY INFORMATION SUPERVISING APPARATUS APPLIED TO HIGH-SPEED RAIL SIGNALING SYSTEM

(71) Applicant: CASCO SIGNAL CO., LTD., Shanghai (CN)

(72) Inventors: Enhua Hu, Shanghai (CN); Pengfei Tu, Shanghai (CN); Xiangbo Yang, Shanghai (CN); Xiaofeng Liu, Shanghai (CN); Xingyu Zhou, Shanghai (CN)

(73) Assignee: CASCO SIGNAL CO., LTD., Shanghai (CN)

( * ) Notice: Subject to any disclaimer, the term of this patent is extended or adjusted under 35 U.S.C. 154(b) by 0 days.

(21) Appl. No.: 18/021,658

(22) PCT Filed: Sep. 24, 2021

(86) PCT No.: PCT/CN2021/120064
§ 371 (c)(1),
(2) Date: Feb. 16, 2023

(87) PCT Pub. No.: WO2023/272975
PCT Pub. Date: Jan. 5, 2023

(65) Prior Publication Data

US 2023/0391386 A1 Dec. 7, 2023

(30) Foreign Application Priority Data

Jun. 29, 2021 (CN) ..... 202110724204.X

(51) Int. Cl.
*B61L 27/57* (2022.01)
*B61L 27/70* (2022.01)

(52) U.S. Cl.
CPC ..... *B61L 27/70* (2022.01); *B61L 27/57* (2022.01)

(58) Field of Classification Search
CPC ..... B61L 27/57; B61L 27/70
See application file for complete search history.

(56) References Cited

U.S. PATENT DOCUMENTS

2019/0031220 A1* 1/2019 Bauer ..... B61L 15/0054
2019/0126961 A1* 5/2019 Potter ..... B61L 27/40
(Continued)

FOREIGN PATENT DOCUMENTS

CN 103569161 A 2/2014
CN 104890702 A 9/2015
(Continued)

OTHER PUBLICATIONS

Chinese Search Report issued in Application No. 202110724204.X, dated Jan. 25, 2022.
(Continued)

*Primary Examiner* — Erick R Solis
(74) *Attorney, Agent, or Firm* — Amster, Rothstein & Ebenstein LLP

(57) ABSTRACT

A safety information supervision apparatus applied to a high-speed rail signaling system includes a communication processor, a Radio Block Center (RBC) interface machine, a Centralized Traffic Control (CTC) interface machine, a supervision and analysis server, an analysis terminal, and a storage device, where the communication processor and the RBC interface machine are communicatively connected to the supervision and analysis server through a monitoring network. The CTC interface machine is communicatively connected to the CTC system of a station and the supervision and analysis server, so as to obtain train information in the CTC system and to transmit an analysis result of the supervision and analysis server to the CTC system through the CTC interface machine. Multi-source data fusion analy-
(Continued)

sis is used to perform filtering and validity analysis on basic data, thereby reducing false alarms.

10 Claims, 2 Drawing Sheets

(56) References Cited

U.S. PATENT DOCUMENTS

| | | | | |
|---|---|---|---|---|
| 2022/0055671 | A1* | 2/2022 | Shifman | H04L 63/1416 |
| 2023/0007046 | A1* | 1/2023 | Kafzan | B61L 15/0027 |
| 2023/0257012 | A1* | 8/2023 | Mo | B61L 25/025 246/122 R |
| 2023/0278603 | A1* | 9/2023 | Na | B61L 23/16 246/167 R |
| 2024/0308560 | A1* | 9/2024 | Kerning | B61L 27/53 |

FOREIGN PATENT DOCUMENTS

| | | | |
|---|---|---|---|
| CN | 104908781 | A | 9/2015 |
| CN | 105629928 | A | 6/2016 |
| CN | 110712667 | A | 1/2020 |
| CN | 111232024 | A | 6/2020 |
| CN | 113335348 | A | 9/2021 |
| DE | 102016217913 | A1 | 3/2018 |
| WO | 2012155836 | A1 | 11/2012 |
| WO | 2015160283 | A1 | 10/2015 |

OTHER PUBLICATIONS

International Search Report issued in PCT/CN2021/120064, dated Mar. 10, 2022.

Written Opinion issued in PCT/CN2021/120064, dated Mar. 10, 2022.

(Liu, Wei et al.) Research on Simulation Test Platform for Railway Train Control Safety Information Monitoring, Chinese Railway, vol. 6, Jun. 15, 2021, pp. 141-146 and figure 1.

* cited by examiner

SAFETY INFORMATION SUPERVISING APPARATUS APPLIED TO HIGH-SPEED RAIL SIGNALING SYSTEM

CROSS-REFERENCE TO RELATED APPLICATIONS

This application is a U.S. national stage entry under 35 U.S.C. § 371 of PCT International Patent Application No. PCT/CN2021/120064, filed Sep. 24, 2021, which claims priority to Chinese Patent Application No. CN 202110724204.X, filed Jun. 29, 2021, the contents of each of which are incorporated herein by reference in their entirety.

TECHNICAL FIELD

The present invention relates to the field of high-speed rail signal equipment maintenance, in particular to a safety information supervising apparatus applied to a high-speed rail signaling system.

BACKGROUND

At present, the main subsystems of high-speed rail, such as interlocking, train control center, track circuit, RBC (Radio Block Center), TSRS (Temporary Speed Restriction Server), etc., are becoming more and more safe and reliable. However, hidden danger prevention and fault supervision of the joint parts of each subsystem still need to be strengthened. The interface and data interaction between each subsystem have become a relatively weak region for the overall application of signaling device for the insufficiency of software release testing, incomplete of manual configuration verification, unclosed-loop of interface data transmission, and deviation of technical specification application. At present, there is no existing device that can supervise the flow of safety information of signaling system between subsystems from the perspective of a third party.

In recent years, there have been several hidden hazards, especially in the RBC system, and only one maintenance terminal is available for the maintenance of the RBC system, which is mainly used to determine the operation status of devices in the RBC system, the communication status of the interface with the external system, and the display of train information, and the display of MA (Movement Authority) and TSRS information. Therefore, the important function of the safety information supervision apparatus applied to the high-speed rail signaling system is to compare the consistency of interfaces of the RBC system, which can realize the functions such as the consistency comparison between the MA and SA (Signaling Authorization) of the RBC system and the consistency comparison among MA and temporary speed limit, speed limit over special terrain, and send serious alarms generated to CTC system (Centralized Traffic Control), thereby providing the basic means for efficient and safe traffic command by traffic commanders.

SUMMARY

In order to overcome the defects in the above-mentioned prior art, the present invention provides a safety information monitoring apparatus applied to a high-speed rail signal system, including a communication processor, an RBC interface machine, a CTC interface machine, a monitoring and analysis server, an analysis terminal, and a storage device;

where the communication processor is communicatively connected to an interlocking system, a TCC system and a ZPW-2000 system of a station to exchange information, and uploads the information to the supervision and analysis server through a monitoring network;

the RBC interface machine is communicatively connected to an RBC system of the station to obtain information including position, speed, SA and MA information of a train, and uploads the position, speed, SA and MA information of the train to the supervision and analysis server through the monitoring network;

the supervision and analysis server is communicatively connected to the analysis terminal and the storage device, correspondingly supervises and analyzes various information uploaded by the communication processor and the RBC interface machine, generates a corresponding analysis result, transmits the analysis result to the analysis terminal, and stores the analysis result in the storage device;

the analysis terminal is communicatively connected to the storage device, and the analysis terminal is capable of reading a historical analysis result of the supervision and analysis server from the storage device, and the historical analysis result is externally displayed and replayed by the analysis terminal; and the CTC interface machine is communicatively connected to the CTC system and the supervision and analysis server of the station, respectively, and transmits the analysis result generated by the supervision and analysis server to the CTC system through the CTC interface machine.

Preferably, the interlocking system, the TCC system, and the ZPW-2000 system are communicatively connected, by respective device terminals thereof, to the communication processor.

Preferably, the communication processor is communicatively connected, through one-way serial connection, to the respective device terminals of the interlocking system, the TCC system, and the ZPW-2000 system, respectively.

Preferably, the communication processor is communicatively connected to a CSM system, and the CSM system is communicatively connected to the interlocking system, the TCC system, and the ZPW-2000 system, respectively, and information is relayed by the CSM system to the communication processor.

Preferably, the information obtained by communicative connection between the communication processor and the interlocking system comprises an in-station representation, route information, a state of a device terminal of the interlocking system;

the information obtained by communicative connection between the communication processor and the TCC system comprises interval representation, track code, logic check, route-in information, and track disaster information; and the information obtained by communicative connection between the communication processor and the ZPW-2000 system comprises an interval collected by the ZPW-2000 system, a state of a track section in the station, and the track code.

Preferably, the RBC interface machine (2) and a device terminal of the RBC system adopt a one-way serial connection manner.

Further, the information obtained by the communicative connection between the RBC interface machine and the RBC system comprises position, speed of the train, and MA information, SA information of the train.

Preferably, the supervision and analysis server adopts a bi-machine heating preparation mode, including a first analysis machine, and a second analysis machine; and the signal uploaded by the communication processor and the RBC interface machine are transmitted to the first analysis machine and the second analysis machine respectively, and the first analysis machine and the second analysis machine simultaneously conduct supervision and analysis and generate two independent analysis results.

Preferably, the first analysis machine and the second analysis machine are communicatively connected to the CTC interface machine, the analysis terminal, and the storage device, respectively.

Preferably, the CTC interface machine performs arbitration on the analysis results of the first analysis machine and the second analysis machine, respectively, and an analysis alarm result that the two analysis results are consistent and affect the operation is transmitted to the CTC system.

Preferably, the supervision and analysis server pushes the analysis results of the first analysis machine and the second analysis machine to the analysis terminal in real time, and the analysis terminal performs arbitration on the consistency of the analysis results of the first analysis machine and the second analysis machine, and gives a real-time pre-alarm prompt when the analysis results are consistent.

Compared with the prior art, the present invention has the following advantages:

1. It strengthens the weakness of the high-speed rail signaling system in analyzing the problems of the system junction as a whole.
2. The accuracy of pre-alarm through bi-machine heating preparation, bi-machine synchronous analysis, and arbitration output is improved.
3. Through bi-serial ports and CTC interface, data interference is effectively reduced.
4. With multi-source data fusion analysis, basic data is filtered and effectively analyzed to reduce false alarms.

DETAILED DESCRIPTION OF THE EMBODIMENTS

A safety information supervision apparatus applied to a high-speed rail signaling system proposed by the present invention will be further described in detail below in conjunction with the accompanying drawings and specific embodiments. The advantages and features of the present invention will become clearer from the following description.

Figure 1:
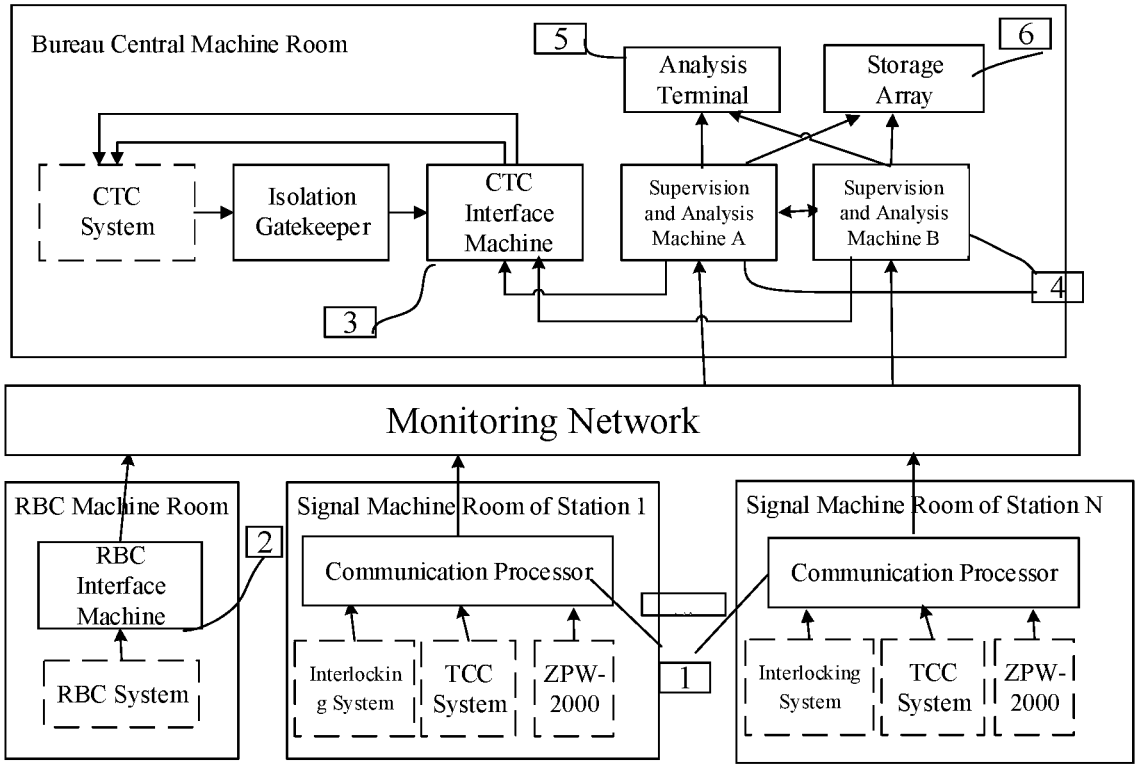
FIG. 1 is a schematic diagram of an apparatus of the present invention.
Figure 2:
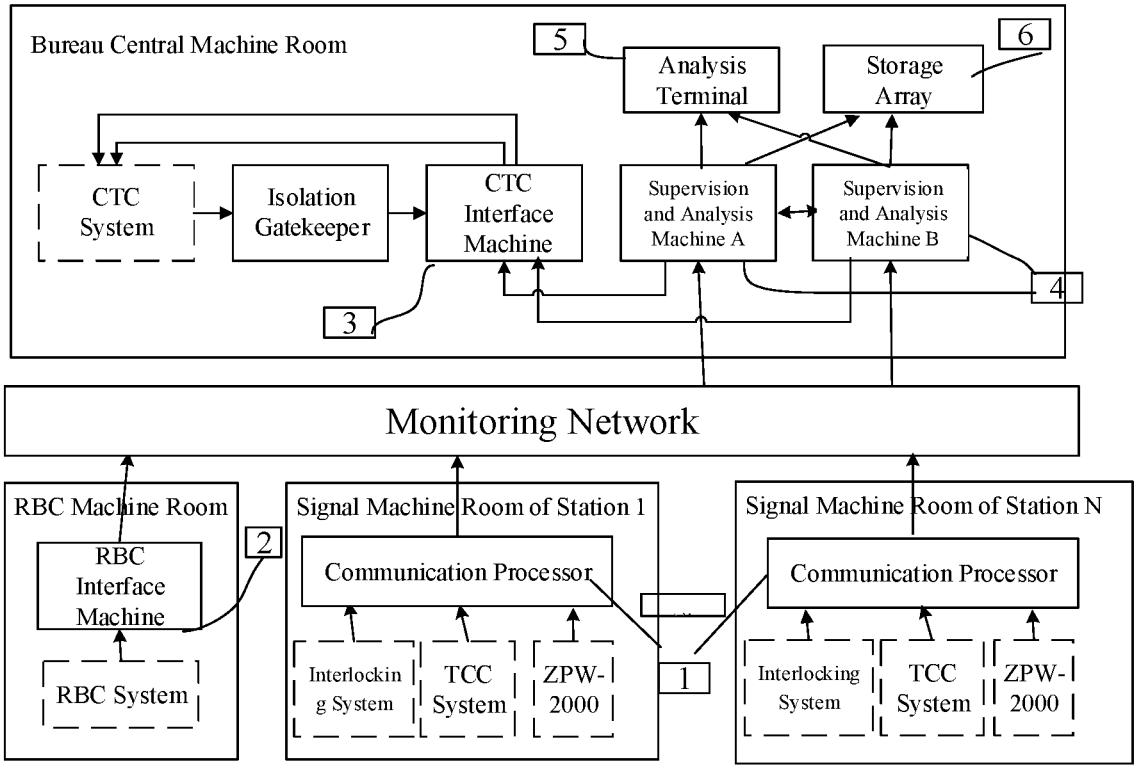
FIG. 2 is another schematic diagram of an apparatus of the present invention.

As shown in FIG. 1 and FIG. 2, a safety information supervision apparatus applied to a high-speed rail signaling system provided by the present invention includes a communication processor 1, an RBC interface machine 2, a CTC interface machine 3, a supervision and analysis server 4, an analysis terminal 5, and a storage device 6. The communication processor 1 and the RBC interface machine 2 are communicatively connected to the supervision and analysis server 4 through a monitoring network.

The communication processor 1 is mainly configured to be communicatively connected to an interlocking system, a TCC (Train Control Center) system and a ZPW-2000 (ZPW-2000 series non-insulated track circuit) system of a station to exchange information, and uploads the information to the supervision and analysis server 4 through a monitoring network. The communication processor 1 is deployed in the signal machine room of the station with 2 interface modes. As shown in FIG. 1, firstly, the communication processor 1 is directly connected to the interfaces of the interlocking system, TCC system, and ZPW-2000 system with a serial communication connection mode. The interlocking system, TCC system and ZPW-2000 system send data unidirectionally to the communication processor 1 to ensure the safety of communication information. As shown in FIG. 2, secondly, the communication processor 1 is connected to the interface of the CSM system (Centralized Signaling Monitoring System, rail signal centralized monitoring system), the CSM system is connected to the interfaces of the interlocking system, the TCC system, the ZPW-2000 system, respectively, and related data is forwarded to the communication processor 1 through the CSM system. The communication processor 1 forwards the received data to the monitoring analysis server 4 through the monitoring network. The communication processor 1 receives the state of switches, the state of sections of the track in the station, the state of signal machines in the station, SA information and the status data of internal devices of the interlocking system from the interlocking system; receives data such as the state of section of intervals of the track, track code, the state of signal machines in the interval, the state of track disaster, the direction of intervals, and the state of device terminals of the TCC system; and receive the state of sections in intervals and in the station, track code, and voltage and current data of each collection point from ZPW-2000 system.

The RBC interface machine 2 is deployed in the RBC computer room, and the RBC interface machine 2 realizes the communication connection with the RBC system through the RBC maintenance terminal while the RBC interface machine 2 is connected to the RBC maintenance terminal with a one-way RS422 interface, and receives train information such as train number, speed, mode, etc., SA information received by the RBC system, and MA information output by the RBC system from the RBC maintenance terminal. The RBC interface machine 2 is connected to the monitoring network, and forwards the received data to the supervision and analysis server 4 through the monitoring network.

The analysis terminal 5 is deployed in the center machine room of the bureau and connected to the monitoring network, the analysis terminal 5 is communicatively connected to the storage device 6, and the analysis terminal 5 is capable of reading a historical analysis result of the supervision and analysis server 4 from the storage device 6, and the historical analysis result is externally displayed and replayed by the analysis terminal 5.

The supervision and analysis server 4 adopts a bi-machine heating preparation mode, that is, the supervision and analysis server 4 includes two analysis machines: a first analysis machine A and a second analysis machine B. The two analysis machines work synchronously and communicate with each other for clock verification. The communication processor 1 forwards the data to the first analysis machine A and the second analysis machine B of the supervision and analysis server 4 synchronously in 2 ways through the monitoring network.

The analysis results of the supervision and analysis server 4 are pushed to the analysis terminal 5 in real time, and the analysis terminal 5 performs arbitration on the consistency of the analysis results of the two machines, and gives a real-time pre-alarm prompt when the analysis results are consistent.

The CTC interface machine 3 is deployed in the central machine room of the bureau group company, and the CTC interface machine 3 is communicatively connected to the CTC system and the supervision and analysis server 4 of the station, respectively, and transmits the analysis result generated by the supervision and analysis server 4 to the CTC system through the CTC interface machine 3. The CTC interface machine 3 interfaces and is connected to the first analysis machine A and the second analysis machine B of the supervision and analysis server 4, respectively. The CTC interface machine 3 performs arbitration on the analysis results output by the first analysis machine A and the second analysis machine B from the supervision and analysis server 4, and forwards the alarms that the two analysis results are consistent and affect the operation to the CTC system. The CTC interface machine 3 is communicatively connected to the CTC system through 2 serial ports and simultaneously sends data to the CTC system through the 2 serial ports to avoid data loss caused by serial port interference.

Part of the functions of the safety information supervision apparatus of the signaling system of the present invention are described below:

(1) The MA output by the RBC system is inconsistent with the state of the ground signaling device: including that the MA crosses the prohibition signal, the MA passes through the occupied section, and the MA is inconsistent with the position of switches. The data sources are as follows:

MA data: from the RBC system;

state of switches: mainly from the interlocking system;

state of signal machines in the station: mainly from the interlocking system;

state of sections in the station: mainly from the interlocking system, others from the TCC system and ZPW-2000 system; and state of sections in the interval: mainly from the TCC system, and others from the ZPW-2000 system.

(2) The SA received by the RBC system is inconsistent with the state of route, including the inconsistency between the position of the switch and the actual position of the switch in SA, the inconsistency between the status of the route and the state of the actual signal machine in SA, and the inconsistency between the status of the routes in SA and the state of blocked sections in the interval. The data sources are as follows:

SA data: from the RBC system;

state of switches: mainly from the interlocking system;

state of signal machines in the station: mainly from the interlocking system;

state of sections in the station: mainly from the interlocking system, others from the TCC system and ZPW-2000 system; and state of sections in the interval: mainly from the TCC system, and others from the ZPW-2000 system;

where the section of the track is divided into the section in the station and the section in the interval in term of position. For the collection of the states of the section in the station and the section in the interval, the range involved in different subsystems is different. For example, the interlocking system only collects the state of the section in the station, and the train control center collects the state of the section in the interval.

(3) The train speed limit curve is inconsistent with the actual situation, including that the current speed of the train exceeds the operating speed of the low-frequency code; and the train speed limit curve is inconsistent with the actual situation.

(4) Temporary speed limit execution status is inconsistent. CTC, TSRS, RBC, and TCC all have temporary speed limit status information. By comparing the temporary speed limit range and execution status consistency of CTC, TSRS, RBC, and TCC systems, a temporary display closed loop supervision is performed.

(5) Inconsistent status of ground signaling device, including inconsistent section occupancy information, inconsistent degraded status of incoming signal machine, inconsistent TCC code sequence and interlocking signal logic, inconsistent direction of intervals of adjacent station, and inconsistent signal display and section code transmission.

(6) Comprehensive display of analysis terminal station map: including MA information, SA information, train location, temporary speed limit, state of basic signaling device, abnormal alarm, etc. The display methods are as follows:

MA information: displayed in green wrapping on both sides of the section;

state of temporary speed limit: displayed in yellow wrapping on both sides of the section;

position of vehicle: displaying train icon, train number, and displaying vehicle related information when the mouse slides over the train, including vehicle ID, current speed, grade, mode, MA reference transponder, and MA offset;

the speed limit curve sent by RBC to the vehicle; and state of basic signaling device: position of switch, signal machine display, section occupancy lock, section low-frequency code information.

When there is an abnormal alarm, a red warning icon will be displayed near it.

To sum up, compared with the prior art, the present invention strengthens the weakness of the high-speed rail signaling system in analyzing the problems of the system junction as a whole. The accuracy of pre-alarm through bi-machine heating preparation, bi-machine synchronous analysis, and arbitration output is improved. Through bi-serial ports and CTC interface, data interference is effectively reduced. With multi-source data fusion analysis, basic data is filtered and effectively analyzed to reduce false alarms.

Although the content of the present invention has been described in detail through the above preferred embodiments, it should be understood that the above description should not be considered as limiting the present invention. Various modifications and alterations to the present invention will become apparent to those skilled in the art upon reading the above disclosure. Therefore, the protection scope of the present invention should be defined by the appended claims.

The invention claimed is:

1. A safety information supervision apparatus applied to a high-speed rail signaling system, comprising: a communication processor, a Radio Block Center (RBC) interface machine, a Centralized Traffic Control (CTC) interface machine, a supervision and analysis server, an analysis terminal, and a storage device;

wherein the communication processor is communicatively connected to an interlocking system, a Train Control Center (TCC) system and a ZPW-2000 system of a station to exchange information, and uploads the information to the supervision and analysis server through a monitoring network;

the RBC interface machine is communicatively connected to an RBC system of the station to obtain information including position, speed, Signaling Authorization (SA) and Movement Authority (MA) information of a train, and uploads the position, speed, SA and MA information of the train to the supervision and analysis server through the monitoring network;

the supervision and analysis server is communicatively connected to the analysis terminal and the storage device, correspondingly supervises and analyzes various information uploaded by the communication processor and the RBC interface machine, generates a corresponding analysis result, transmits the analysis result to the analysis terminal, and stores the analysis result in the storage device;

the analysis terminal is communicatively connected to the storage device, and the analysis terminal is capable of reading a historical analysis result of the supervision and analysis server from the storage device, and the historical analysis result is externally displayed and replayed by the analysis terminal; and the CTC interface machine is communicatively connected to the CTC system and the supervision and analysis server of the station, respectively, and transmits the analysis result generated by the supervision and analysis server to the CTC system through the CTC interface machine.

2. The safety information supervision apparatus according to claim 1, wherein the interlocking system, the TCC system, and the ZPW-2000 system are communicatively connected, by respective device terminals thereof, to the communication processor; and the communication processor is communicatively connected, through one-way serial connection, to the respective device terminals of the interlocking system, the TCC system, and the ZPW-2000 system, respectively.

3. The safety information supervision apparatus according to claim 1, wherein the communication processor is communicatively connected to a Centralized Signaling Monitoring System (CSM) system, and the CSM system is communicatively connected to the interlocking system, the TCC system, and the ZPW-2000 system, respectively, and information is relayed by the CSM system to the communication processor.

4. The safety information supervision apparatus according to claim 2, wherein the information obtained by communicative connection between the communication processor and the interlocking system comprises an in-station representation, route information, and a state of a device terminal of the interlocking system;

the information obtained by communicative connection between the communication processor and the TCC system comprises interval representation, track code, logic check, route-in information, and track disaster information; and the information obtained by communicative connection between the communication processor and the ZPW-2000 system comprises an interval collected by the ZPW-2000 system, a state of a track section in the station, and the track code.

5. The safety information supervision apparatus according to claim 1, wherein the RBC interface machine and a device terminal of the RBC system adopt a one-way serial connection manner.

6. The safety information supervision apparatus according to claim 5, wherein the information obtained by the communicative connection between the RBC interface machine and the RBC system comprises position, speed of the train, and MA information, and SA information of the train.

7. The safety information supervision apparatus according to claim 1, wherein the supervision and analysis server adopts a bi-machine heating preparation mode, including a first analysis machine, and a second analysis machine; and the signal uploaded by the communication processor and the RBC interface machine are transmitted to the first analysis machine and the second analysis machine respectively, and the first analysis machine and the second analysis machine simultaneously conduct supervision and analysis and generate two independent analysis results.

8. The safety information supervision apparatus according to claim 7, wherein the first analysis machine and the second analysis machine are communicatively connected to the CTC interface machine, the analysis terminal, and the storage device, respectively.

9. The safety information supervision apparatus according to claim 8, wherein the CTC interface machine performs arbitration on the analysis results of the first analysis machine and the second analysis machine, respectively, and an analysis alarm result that the two analysis results are consistent and affect the operation is transmitted to the CTC system.

10. The safety information supervision apparatus according to claim 8, wherein the supervision and analysis server pushes the analysis results of the first analysis machine and the second analysis machine to the analysis terminal in real time, and the analysis terminal performs arbitration on the consistency of the analysis results of the first analysis machine and the second analysis machine, and gives a real-time pre-alarm prompt when the analysis results are consistent.

* * * * *